US005335506A

United States Patent [19]

Byoung-Moo

[11] Patent Number: 5,335,506

[45] Date of Patent: Aug. 9, 1994

[54] REGENERATIVE HEAT PUMP

[75] Inventor: Lee Byoung-Moo, Kyonggi, Rep. of Korea

[73] Assignee: Samsung Electronics Co., Ltd., Suwon, Rep. of Korea

[21] Appl. No.: 999,400

[22] Filed: Dec. 31, 1992

[30] Foreign Application Priority Data

Jan. 7, 1992 [KR] Rep. of Korea ..... 92-65

[51] Int. Cl.[5] ..... F25B 9/00

[52] U.S. Cl. ..... 62/6; 60/519

[58] Field of Search ..... 62/6; 60/517, 520, 524, 60/519

[56] References Cited

U.S. PATENT DOCUMENTS

| | | | |
|---|---|---|---|
| 2,664,698 | 1/1954 | Van De Poll et al. | 60/524 |
| 4,417,443 | 11/1983 | Lorant | 60/525 |
| 4,683,723 | 8/1987 | Doi et al. | 62/6 |
| 5,174,116 | 12/1992 | Ishikawa | 60/520 |
| 5,174,117 | 12/1992 | Naito et al. | 60/520 |

FOREIGN PATENT DOCUMENTS

| | | | |
|---|---|---|---|
| 1288461 | 2/1987 | U.S.S.R. | 62/6 |

*Primary Examiner*—Henry A. Bennet
*Assistant Examiner*—William C. Doerrler
*Attorney, Agent, or Firm*—Burns, Doane, Swecker & Mathis

[57] ABSTRACT

A regenerative heat pump includes a main compartment divided into three chambers by two reciprocable displacers. Gas in the main compartment is heated. A drive mechanism is driven by a start-up motor and is connected to the displacers to reciprocate those displacers. A flow path interconnects the chambers and exchanges heat with a heat exchanger. A secondary compartment contains a piston and communicates with the main compartment so that gas from the main compartment drives the piston. The piston is connected to the drive mechanism so that when the heat pump reaches a steady state, the start up motor can be shut-off, whereupon the piston reciprocates the displacers.

4 Claims, 4 Drawing Sheets

REGENERATIVE HEAT PUMP

BACKGROUND OF THE INVENTION

1. Field of the Invention

The present invention relates to a regenerative heat pump.

2. Description of the Prior Art

A regenerative heat pump typically produces an output power required for heating or cooling a certain space by compressing or expanding a gas such as helium which is filled in a cylinder.

Generally, the interior of the cylinder of such a regenerative heat pump is divided into three chambers, that is, a high temperature chamber, a medium temperature chamber and a low temperature chamber by way of two displacers. A gas filled in the high temperature chamber is directly heated by means of an external heating means.

The displacers reciprocate in the cylinder by the expansion of the gas heated and, also, by the rotation of a crank which is connected to each rod of the displacers. The crank is rotated by means of a motor.

The gas is fed into the three chambers by the displacers displaced due to the expansion of the gas as well as the rotation of the crank. The temperatue of the gas contained in the respective chambers rises up to a level of a steady state and is maintained at a constant temperature level. At this time, the displacers are continuously moved.

For the chambers of the cylinder, the compression and expansion of the gas is repeated so that the heat pump produces a work, that is, a heating or cooling work according to the compression or expansion of the gas.

FIG. 1 shows such a conventional regenrative heat pump. As seen from the drawing, the heat pump includes a cylinder 31 of which the interior is divided into three spaces, that is, a high temperature chamber 38, a medium temperature chamber 39 and a low temperature chamber 40 by high and a low temperature displacers 32 and 33. These chambers are different in temperature. The high temperature displacer 32 is connected through a first connecting rod 34 to a crank member and the low diplacer 33 is also connected to the crank member 43 through a second connecting rod 35. The first and second connecting rods 34 and 35 are connected to the crank member 43 in a phase difference relation of 90 degrees.

A heat tube 36 is formed integrately with a head 49 of the cylinder 31 and is communicated to the high temperature chamber 38. The heat tube 36 is directly heated by means of an external heating means or heater 37 and executes a direct heat transfer to the gas contained in the high temperature chamber 38. When the heating means 37 begins to heat the tube 36, the crank member 43 is moved by a motor (not shown) and the displacers 32 and 33 reciprocate in the cylinder 31 in accordance with the heating expansion of the gas and the rotation of the crank member 43.

Multiple O-rings are disposed on an external periphery surface of the displacers 32 and 34 to prevent a leak of the gas from the respective chambers. The gas is fed to the high temperature chamber 38, the medium temperature chamber 39 and the low temperature chamber 40 through a flow path 45 which is arranged at an external periphery of the cylinder 31 and extended into the respective chambers 38, 39 and 40.

In addition, a high temperature regenerator 41 is disposed at a predetermined position of the flow path defined between the high temperature chamber 38 and the medium temperature chamber 39. A low temperature regenerator 42 is disposed at a predetermined position of the flow path between the medium temperature chamber 39 and the low temperature chamber 40. These high and low temperature regenerators 41 and 42 absorb or radiate heat from the gas to control the temperature of the respective chambers 38, 39 and 40 constantly.

As mentioned above, a variation of pressure in a closed system occurs due to the displacement of the displacers 32 and 33 located in the cylinder 31 and the repeated compression and expansion of the gas is carried out in the system to produce the heating or cooling work.

With such a conventional regenerative heat pump, each volume of the high, medium and low temperature chambers 38, 39 and 40 defined by the displacers 32 and 33 is varied according to the displacement of the displacers 32 and 33 while the total volume of the chambers 38, 39 and 40, that is, of the cylinder 31 remains constant.

Further, such a heat pump cannot produce a work w expressed by the following equation 1 for obtaining the heating or cooling work.

$$W=\oint PdV_T=P(V_{T2}-V_{T1}) \quad (1)$$

where, $dV_T$ is defined by d $(V_H+V_M+V_L)$; P denotes a total pressure, $V_T$ is the total volume of chambers 38, 39, 40, $V_H$ is the volume of the high temperature chamber, $V_M$ is the volume of the medium temperature chamber, $V_L$ is the volume of the low temperature chamber.

Referring to FIG. 2*a*, it is undertood that even if the volumes of the respective chambers 38, 39 and 40 are varied as shown in the drawing, the total volume, that is, the volume of a rectangular region defined by the sum $V_T(=V_H+V_M+V_L)$ is unchanged, and the pressure is varied while the volume is unchanged as shown in FIGS. 2*b* and 2*c*.

Accordingly, in such a conventional regenerative heat pump, the total volume $V_T$ of the chambers can be obtained by a relation of $V_{T2}=V_{T1}$. Therefore, in the above equation 1, W equals zero, so even if the total pressure of the system is varied, a work for heating or cooling output is not assurred because the total volume $V_T$ is unchanged. Therefore, the displacers 32 and 33 cannot themselves produce a driving force.

For this reason, the motor must be continuously operated so as to continue the operation of the displacers 32 and 33. As a result, power consumption is greatly increased and where the motor is operated for a long time, a heat generated undesirably affects the motor, resulting in a reduction of the life time of the motor and thus requiring an additional means for cooling the motor.

SUMMARY OF THE INVENTION

Accordingly, an object of the present invention is to provide a regenerative heat pump which after being started can be continuously operated without further need for a motor.

To achieve the above object, the present invention contemplates a regenerative heat pump comprising: a motor for producing a driving force for an initial driving duration; a main cylinder member integratedly formed a crank case and having a head portion formed with a heat tube, the main cylinder member being filled with a gas such as helium; high and low displacers having a high temperature rod and low temperature rod, respectively, for reciprocating upward and downward from a top to a bottom of the main cylinder and for defining an interior of the cylinder member into three chambers such as a high temperature chamber, a medium temperature chamber and a low temperature chamber, these chambers having different temperatures, respectively; a crank member located within the crank case for converting the rotating motion of the motor into the reciprocating motion of the displacers representing a phase difference, the crank member being connected to the high and low temperature rods with the low temperature rod having earlier phase than the high temperature rod by an angle of 90 degrees; a first flow path formed on an outer side of the main cylinder member for communicating the chamber, the path having a high and low temperature regenerators and a heat-exchanging unit disposed therein; and, a second path formed on an outer side of the crank case in a spaced relation to the main cylinder member by a predetermined angle and having a piston member reciprocated therein and a piston rod, the piston rod being connected to the crank member at a position where the high temperature rod is connected and the second path communicating the space defined by the piston member with the low temperature chamber of the main cylinder member.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE INVENTION

Thereinafter, a preferred example of the present invention will be described in more detail.

Figure 1:
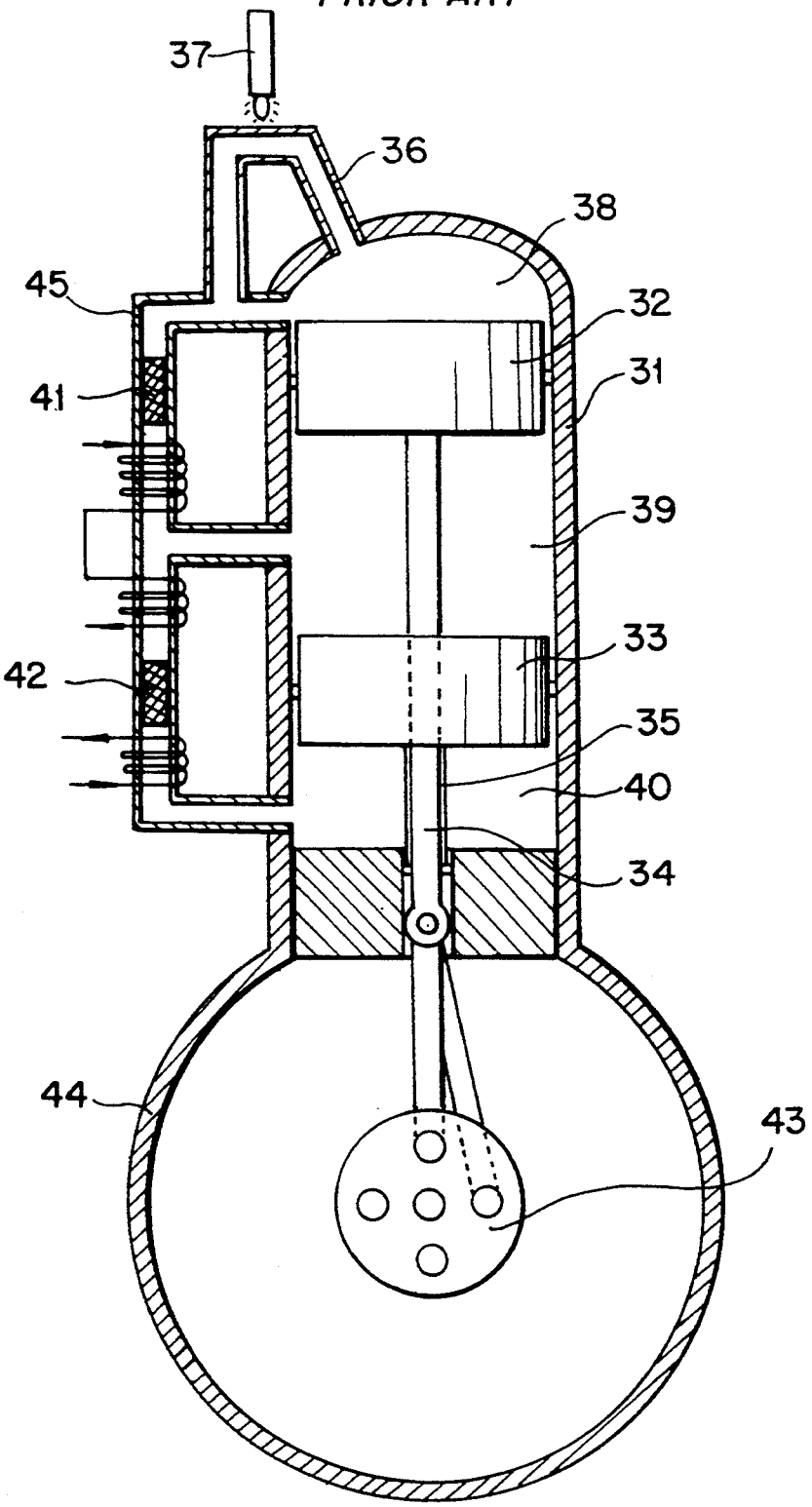
Fig. 1 PRIOR ART
FIG. 1 is a sectional view of a conventional regenerative heat pump.
Figure 2A:
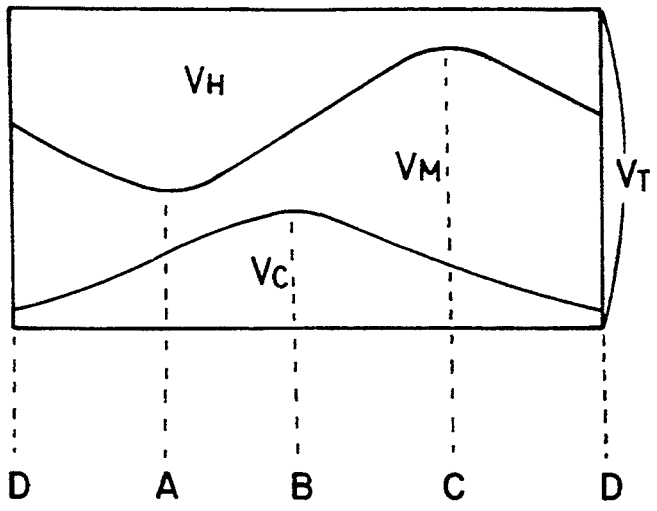
Fig. 2a PRIOR ART
FIG. 2*a* is a diagram illustrating a variation of the volumes of respective chambers defined in the heat pump of FIG. 1 with the lapse of time.
Figure 2B:
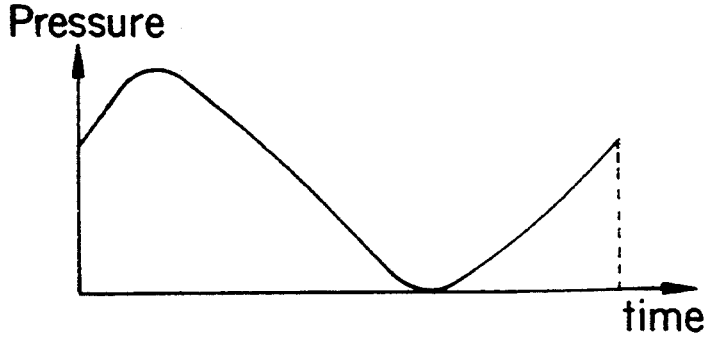
Fig. 2b PRIOR ART
FIG. 2*b* is a diagram illustrating a variation of a pressure of the heat pump in FIG. 1 with the lapse of time.
Figure 2C:
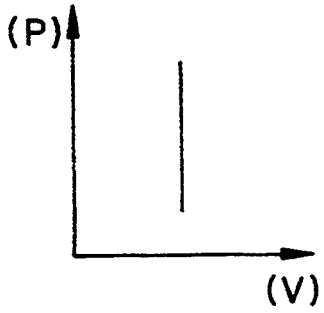
Fig. 2c PRIOR ART
FIG. 2*c* is a diagram illustrating a relation of the pressure to volume of the heat pump in FIG. 1.
Figure 3:
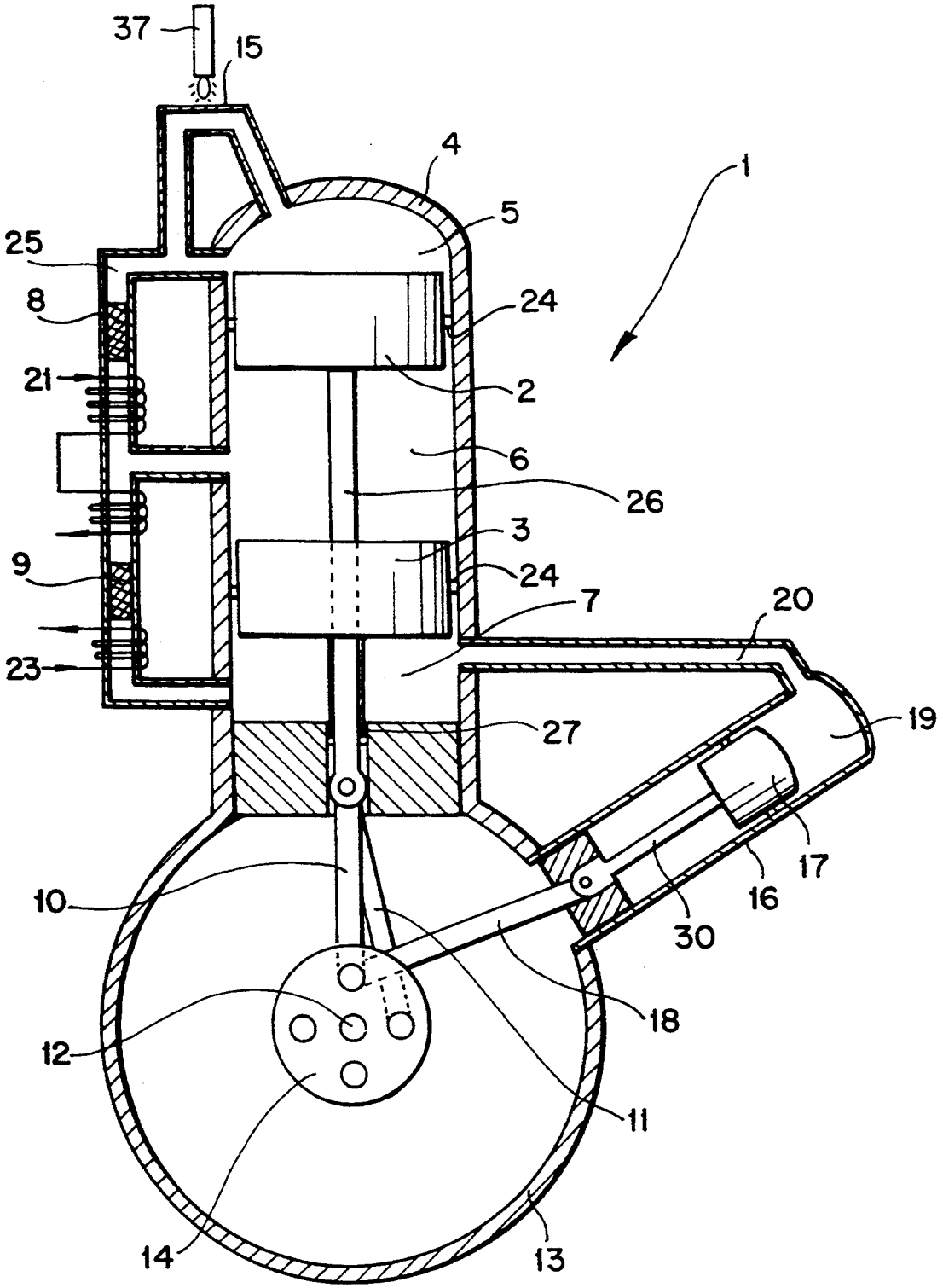
FIG. 3 is a sectional view showing a preferred example of a regenerative heat pump according to the present invention.

Referring to FIG. 3, a regenerative heat pump comprises a crank case 13 having a crank member 14 located therein, a main cylinder member 4 integratedly formed with the crank case 13, and an auxiliary or sub cylinder member 16 extended from a portion of the crank case 13 at a angle to the main cylinder member 4. A pair of displacers 2 and 3, that is, high termperature and low temperature displacers reciprocate in a main compartment formed by the main cylinder member 4.

The interior of the main cylinder member 4 is filled with a gas such as helium and divided into a high temperature chamber 5, a medium temperture chamber 6 and a low temperature chamber 7 by means of the high and low temperature displacers 2 and 3. The three chambers 5, 6 and 7 have different temperature from each other. The high temperature chamber 5 and the low temperature chamber 7 are substantially identical in volume and the medium temperature chamber 6 has a volume larger than those of the chambers 5 and 7.

A heat tube 15 is connected to a head portion of the main cylinder member 4 in a fluid(gas) communicating relation with the high temperature chamber 5. The heat tube 15 is directly heated by an external heating means or heater 37 and transfers a heat to the high temperature chamber 5. A first path 25 is connected to an outer surface of the main cylinder member 4 to communicate the chambers 5, 6 and 7 with each other. More specifically, the high and low temperature regenerators 8 and 9 are disposed in the first path 25 and a medium temperature heat-exchanger 21 and a low temperature heat-exchanger 23 are arranged at a periphery surface of the first path 25.

The high temperature displacer 2 is located at an upper side of the interior of the main cylinder member 4 so as to define the high temperature chamber 5. The displacer 2 has a high temperature rod 26 connected to the first connecting rod 10. On the contrary, the low temperature displacer 3 is located at a lower side of the main cylinder member 4 in such a way that it defines the low temperature chamber 7 in the main cylinder member 4.

The medium temperature chamber 6 is defined by the high and low temperature displacers 2 and 3. The low temperature displacer 3 has a low temperature rod 27 connected to the second connecting rod 11. O-rings 24 are mounted on the periphery portions of the displacers 2 and 3 to block the gas flowing between the chambers 5, 6 and 7.

The first connecting rod 10 is connected to the crank member 14, the second connecting rod 11 is connected to the crank member 14 while maintaining an advanced phase difference of 90 degrees relative to the first connecting rod 10. The crank member 14 is coupled to a start up motor (not shown) through a crank shaft 12 so as to convert the rotation of the motor into the reciprocation of the displacers 2 and 3 together with the first and second connecting rods 10 and 12.

The sub-cylinder member 16 extends at a predetermined angle, relative to the main cylinder 4 for example, an angle within 90 degrees and is integrally formed with the crank case 13. The sub-cylinder member 16 is mounted to the crank case 13 to be sealed by way of a welding, brazing or the like. A volume of a or secondary compartment 19 of the sub-cylinder member 16, which is filled with a gas, for example, helium, is smaller than the high temperature chamber 5 or low temperature chamber 7 of the main cylinder member 4 by about 0.3–0.4 times, preferably, 0.36 times for obtaining the better efficiency The inside diameter of the sub-cylinder member 16 is smaller than that of the main cylinder member 4 by 0.6 times.

The space 19 in the sub-cylinder member 16 is communicated with low temperature chamber 7 of the main cylinder member 4 through a second path 20. A third connecting rod 18 connected to the piston rod 30 of the sub-cylinder member 16 is connected to the crank member 14 at a position where the first connecting rod 10 is connected to the crank member 14. That is, the third connecting rod 18 is connected to the crank member 14 with a retarded phase difference of 90 degrees relative to the second connecting rod 11. Also, since three connecting rods 10, 11 and 18 are connected to the crank member 14 at an identical distance from a center point of the crank member 14, the high and low temperature displacers 2 and 3 have the same stroke as that of the piston member 17.

In the regenerative heat pump 1 of the present invention the crank member 14 is driven by the motor (not shown) to obtain an initial driving force and simultaneously the heat tube 15 of the heat pump 1 is heated by means of the external heating member.

The heat tube 15 transfers the heat to the high temperature chamber 5 so that the gas in the chamber 5 expands by the heat. Accordingly, the high and low temperature displacers 2 and 3 and the piston member 17 reciprocate by the rotation of the motor and by the expansion of the gas. The high temperature displacer 2 and the low temperature displacer 3 are spaced from each other within a phase difference of 90 degrees, the piston member 17 reciprocates with a phase difference to the high and low temperature displacers 2 and 3.

With a lapse of time from the start of the heat pump, the temperature of the gas in each of the chambers 5, 6 and 7 arrived at a steady state. More specifically, when the gas temperature in the high temperature chamber 15 is maintained at a certain temperature point in a range of 500°~700° C., the medium temperature chamber 6 is maintained at a certain temperature point in a range of about 40°~100° C., and the low temperature chamber 7 is maintained at a certain temperature point of a temperature range of −5° C. to 10° C., when this steady state occurs, the motor is stopped, and the displacers 2 and 3 and the piston member 17 continuously reciprocate by heating operation of the heater (not shown) only.

The reciprocation of the displacers 2 and 3 and the piston member 17 change the volumes of the chambers 5, 6 and 7 as well as the volume of the space 19. In this case, the gas in the respective chambers 5, 6 and 7 and in the space 17 are moved into the other chambers. For example, when the volume of the high temperature chamber 5 is reduced, the heated gas in the chamber 5 is moved into the medium temperature chamber 6 and low temperature chamber 7. At this time, the high temperature regenerator 8 absorbs and stores the heat from the highly heated gas. The medium temperature heat-exchanger 21 serves as a water supply circulating heat-exchanger with the high temperature gas to produce the heating output power.

When the low temperature displacer 3 is downwardly moved, the gas contained in the low temperature chamber 7 is moved into the high and medium temperatures 5 and 6 through the first path 25 and simultaneously moved into the space 19 through the second path 20. The gas flowing into the chambers 5 and 6 through the first path 25 exchanges heat with the low temperature heat-exchanger 23, the low temperature regenerator 9 and the medium temperature heat-exchanger 21 to thereby maintain the gases in the chambers 5 and 6 at a constant temperature. The low temperature heat-exchanger 23 serving as a water supply circulating heat-exchanger exchanges heat with the low temperature gas.

In the regenerative heat pump according to the present invention, the volume of the space 19 defined in the sub-cylinder member 16 communicated with the low temperature chamber 7 is varied according to the reciprocation of the piston member 17 and the total volume of the system is thus changed. More specifically, because the volume of the sapce 19 is changed by the piston member 17 which is operated with a phase difference to the high and low displacers 2 and 3, the variation of the volume of the entire system is occurred.

Next, the description will be made with respect to the variation of the volume of the chambers 5, 6 and 7 when the crank member 14 is clockwisely rotated.

If the high temperature displacer 2 is positioned at the top of its stroke, that is, if the volume $V_H$ of the high temperature chamber 5 is minimized, the volume $V_{L1}$ of the low temperature chamber 7 is reducing as the displacer 3 is downwardly moved. The volume $V_{L2}$ of the space 19 is reducing due to the upwardly moving of the pistion member 17 because the latter 17 is spaced away from the low temperature displacer 3 by an angle within 90 degrees.

Figure 4A:
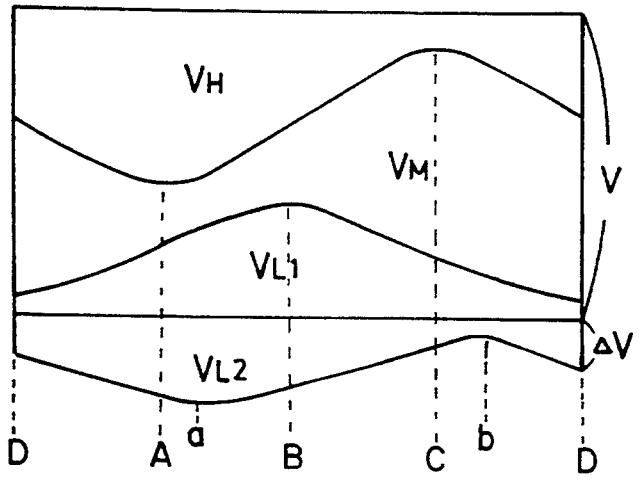
FIG. 4*a* is a diagram illustrating a variation of a pressure of chambers in the heat pump in FIG. 3 with the lapse of time.

Referring to FIG. 4*a*, it can be seen that if the space 19 of the sub-cylinder member 16 is a maximum volume at point a of the operating cycle, the volume $V_H$ of the high temperature chamber 5 is reducing and the volume $V_{L1}$ of the low temperature chamber 7 is increasing.

As seen from FIG. 4*a*, the total volume of the main cylinder member 4 is V and the volume $V_{L2}$ of the space 19 of the sub-cylinder member 14 is $\Delta V$. Accordingly, it is understood that the total volume $(V+\Delta V)$ of the system is increased and reduced repeatedly.

As the space 19 and the low temperature chamber 7 are communicated with each other through the second path 20, the total low temperature volume $V_L$ of the system becomes $V_{L1}+V_{L2}$.

As mentioned above, while the entire volume V of the main cylinder member 4 is constant, the volume $\Delta V$ of the sub-cylinder member 16 is changed. Therefore a point a (see FIG. 4*a*) where the volume of the space 19 defined in the sub-cylinder member 16 is maximum, a bottom dead center of the piston member 17, and occurs at a position b where the volume of the space 19 is minimum occurs at a top dead center of the piston member 17. The bottom dead center a of the member 17 is an ending point of an expansion procedure of the heat pump.

When the piston member 17, therefore, is moved from the bottom dead point a to the top dead point b, the heating work can be produced by way of an compressing process in which the total volume $V_T$ of the system is reduced. Alternatively, when the piston member 17 is moved from the top dead center b to the bottom dead center a, the cooling work can be produced by an expansion process in which the total volume $V_T$ of the system is increased.

Figure 4B:
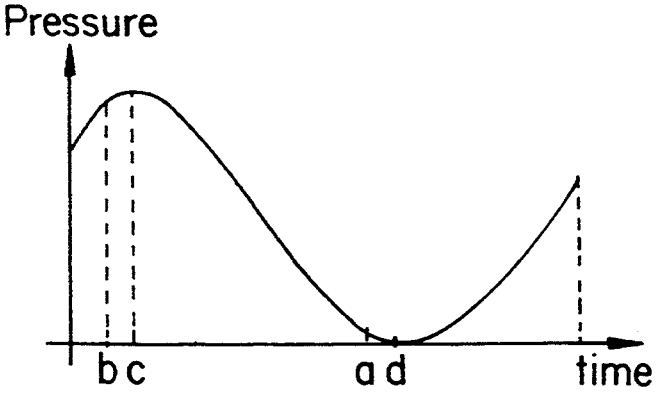
FIG. 4*b* is a diagram illustrating a variation of a pressure of the heat pump FIG. 3 with the lapse of time; and, FIG. 4*c* is a diagram of illustrating a variation of a pressure to volume of the heat pump in FIG. 3.
Figure 4C:
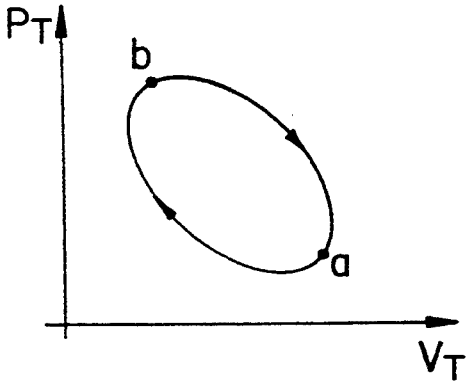

FIG. 4*b* is a graph showing a variation of pressure of the heat pump to time, and FIG. 4*c* shows a diagram showing a variation of the pressure to the volume of the heat pump.

Referring to FIG. 4*b*, it can be seen that the point b at which the piston member 17 reaches the top dead center is earlier than the maximum pressure point c, while the point at which the piston member 17 reaches the bottom dead center is ealier than the minimum pressure point d. In FIG. 4*c*, two points a and b on a closed loop denote the top and bottom dead centers of the piston member 17, respectively, a→b represents the compression process and b→a represents the expansion process. The area enclosed by the closed loop represents an amount of the work w which can be calculated by the following formula.

$$W=\oint P\,dV_T=P(V_{T2}-V_{T1})>0 \quad (2)$$

where, $V_{T2}$ denotes the total volume of the system when the piston member 17 is positioned at the bottom dead center, $V_{T1}$ denotes the total volume of the system when the piston member 17 is positioned at the top dead conter, and P denotes a pressure of the system.

As previously described, the work w can be produced in accordance with the variation of the volume of the entire system.

As noted above, the heat pump according to the present invention has the sub-cylinder member provided in the crank case extending from the main cylinder member by a predetermined angle. The space defined in the subcylinder member is communicated with the low temperature chamber of the main cylinder member and the piston member thereof has a phase different from the phases of the high and low temperature displacers of the main cylinder. Accordingly, the total volume of the system is changed and the work w is thus produced by the formula: $W=\oint pdV>0$. As a result, once reaching a steady state the system can be independently operated by using the heating power without the need for a motor.

Although the present invention has been described with respect to the specified example, it will be apparent that various modifications and changes will be made therein without departing from the spirit and scope of the invention.

What is claimed is:

1. In a regenerative heat pump, comprising a main compartment containing a gas; heating means for heating the gas; a high displacer and a low displacer slidably disposed in said main compartment and dividing said main compartment into three chambers of different temperature; a drive mechanism connected to said high and low displacers for displacing said high and low displacers; a start-up motor connected to said drive mechanism for initially driving said drive mechanism; and a secondary compartment containing a piston; the improvement comprising:

a gas flow path interconnecting said chambers, said gas flow path including high and low temperature regenerators, and a heat exchanging unit for conducting output heat away from the heat pump;

said drive mechanism comprising a crank member, a first connecting rod connecting said high displacer to said crank member, and a second connecting rod connecting said low displacer to said crank member at a location spaced ninety degrees ahead of a location where said first connecting rod is connected to said crank member;

said main and secondary compartments forming therebetweeen and angle no greater than ninety degrees.

2. A regenerative heat pump according to claim 1 including a third connecting rod connected to said piston and connected to said crank member at said location where said first connecting rod is connected to said crank member.

3. A regenerative heat pump according to claim 1, wherein said three chambers comprise a high temperature chamber, a medium temperature chamber, and a low temperature chamber, said secondary compartment communicating with said low temperature chamber.

4. A regenerative heat pump according to claim 1, wherein said main and secondary compartments are formed by main and secondary cylinders, respectfully, said secondary cylinder having a diameter that is about 0.6 times that of said main cylinder.

* * * * *